US011679526B2

(12) United States Patent
Zhou et al.

(10) Patent No.: US 11,679,526 B2
(45) Date of Patent: Jun. 20, 2023

(54) METHOD AND SYSTEM FOR A CONTINUOUS WOOD MODIFICATION HEAT PROCESS

(71) Applicants: Ming Wu Zhou, Yorba Linda, CA (US); Xiong Wang, Hunan (CN)

(72) Inventors: Ming Wu Zhou, Yorba Linda, CA (US); Xiong Wang, Hunan (CN)

( * ) Notice: Subject to any disclaimer, the term of this patent is extended or adjusted under 35 U.S.C. 154(b) by 367 days.

(21) Appl. No.: 16/882,755

(22) Filed: May 26, 2020

(65) Prior Publication Data

US 2021/0154884 A1 May 27, 2021

(51) Int. Cl.
*B27K 5/00* (2006.01)
*F26B 3/04* (2006.01)
(Continued)

(52) U.S. Cl.
CPC ..... *B27K 5/001* (2013.01); *B27K 5/0055* (2013.01); *F26B 3/04* (2013.01); *F26B 3/347* (2013.01);
(Continued)

(58) Field of Classification Search
CPC .... F26B 3/04; F26B 3/347; F26B 5/14; F26B 21/08; F26B 21/10; B27K 5/001; B27K 5/0055; H05B 6/6479; H05B 6/72
(Continued)

(56) References Cited

U.S. PATENT DOCUMENTS 3,574,949 A * 4/1971 Farnsworth ..... F26B 23/005 34/407
3,757,428 A * 9/1973 Runciman ..... F26B 25/185 432/66
(Continued)

FOREIGN PATENT DOCUMENTS

EP 2535156 B1 * 10/2014 ..... B27K 5/0075
WO WO-2012172585 A3 * 4/2013 ..... B27K 5/0075

*Primary Examiner* — Stephen M Gravini
(74) *Attorney, Agent, or Firm* — InHouse Co. Law Firm; Theodore S. Lee, Esq.; Alexander Chen, Esq.

(57) ABSTRACT

A continuous wood modification by heat process, that comprises: stacking wooden boards on a trolley at intervals; exerting pressure on said wooden boards; transferring said wooden boards to a heating kiln, pre-heated by microwave and hot air circulation, that has a water vapor flow of 2-5 meter3/hour, a temperature range of 60-100° C., and a humidity range of 50%-100%; transferring said wooden boards to a shallow drying kiln, pre-heated by microwave and hot air circulation, that has a drying temperature of 100-120° C.; transferring said wooden boards to a deep drying kiln, pre-heated by microwave and hot air circulation, that has a drying temperature of 120-120° C., an oxygen content range of 1-10%, and a water vapor flow rate of 1-10 m3/hour; transferring said wooden boards to a carbonization kiln, pre-heated by microwave and hot air circulation, that has a temperature range of 120-180° C., an oxygen content range of 1%-5%; transferring said wooden boards to a slow cooling kiln, that has a temperature range of 120-130° C., and an oxygen content range of 1%-10%; transferring said wooden boards to a fast cooling kiln, that has a temperature range of 90-100° C.; transferring said wooden boards to a rewetting kiln, that has a humidity range of 50%-100%; providing water vapor to said rewetting kiln; while being in said rewetting kiln, and when a temperature range of said wooden boards is 40-60° C., and a moisture content of said wooden boards is 6%-10%, transferring said wooden boards out of said rewetting kiln; wherein each of said heating kiln, said shallow drying kiln, said deep drying kiln, said carbonization kiln, said slow cooling kiln, said fast cooling kiln, and said rewetting kiln comprises a fan, a partition board, a shunt hood, and an exhaust port; wherein said partition board divides an interior of each of said heating kiln, said shallow drying kiln, said deep drying kiln, said carbonization kiln, said slow cooling kiln, said fast cooling kiln, and
(Continued)

said rewetting kiln into an upper chamber and a lower chamber; wherein said shunt hood is disposed in said upper chamber; wherein said fan, said shunt hood, and said lower chamber are connected and form a air channel; wherein said lower chamber comprises a shunt plate, disposed along left and right walls of a kiln; wherein said shunting plate comprises a plurality of sieve holes that are disposed gradually dense from top to bottom; wherein one end of said shunt plate is connected with said partition board and the other end is connected with the bottom of a kiln.

16 Claims, 10 Drawing Sheets

(51) Int. Cl.

| | |
|---|---|
| ***F26B 3/347*** | (2006.01) |
| ***F26B 5/14*** | (2006.01) |
| ***F26B 21/08*** | (2006.01) |
| ***F26B 21/10*** | (2006.01) |
| ***H05B 6/64*** | (2006.01) |
| ***H05B 6/72*** | (2006.01) |

(52) U.S. Cl.
CPC ..... *F26B 5/14* (2013.01); *F26B 21/08* (2013.01); *F26B 21/10* (2013.01); *H05B 6/6479* (2013.01); *H05B 6/72* (2013.01)

(58) Field of Classification Search
USPC ..... 432/18
See application file for complete search history.

(56) References Cited

U.S. PATENT DOCUMENTS

| | | | | | |
|---|---|---|---|---|---|
| RE31,633 | E * | 7/1984 | Lewis | F26B 21/02 | 34/381 |
| 4,466,198 | A * | 8/1984 | Doll | F26B 9/006 | 34/68 |
| 4,620,373 | A * | 11/1986 | Laskowski | F26B 23/06 | 34/406 |
| 4,893,415 | A * | 1/1990 | Moldrup | F26B 5/04 | 34/406 |
| 6,293,121 | B1 * | 9/2001 | Labrador | F03D 5/00 | 62/304 |
| 8,291,611 | B2 * | 10/2012 | Eriksen | F26B 23/10 | 34/92 |
| 10,344,218 | B2 * | 7/2019 | Pagnozzi | C10L 9/083 | |
| 2004/0168339 | A1 * | 9/2004 | Roberts | F26B 9/06 | 34/218 |
| 2021/0154884 | A1 * | 5/2021 | Zhou | H05B 6/80 | |

* cited by examiner

METHOD AND SYSTEM FOR A CONTINUOUS WOOD MODIFICATION HEAT PROCESS

FIELD OF THE INVENTION

The present invention is directed generally to a system and method of wood processing, in particular to a continuous wood modification heat process method and system.

BACKGROUND OF THE INVENTION

Wood comes from nature, and, because of its beautiful natural texture and color, it is deeply loved by people. Due to the biological properties and various characteristics of wood, when the external humidity and temperature change, wood is prone to drying shrinkage and wet expansion, and, thus, makes any structure made of these woods unstable or disfigured due to the movement of individual wooden components, and this characteristic has a negative impact on the utilization of wood.

The internal moisture content of a fresh wood log is relatively high. If the wood log is directly processed into boards without pre-processing, as the internal moisture evaporating due to the ambient high temperature or low humidity, which leads to the concave or cracking of the boards. Vice versa, in a high humidity environment, the water vapor in the air causes the wood cells to absorb water and expand, and the boards will bulge or expand. Whether they are concave or convex, they will cause the unevenness of the boards and affect the structure made of them. Therefore, in order to overcome this problem, the wood will be generally modified after being cut from the trees.

The research of wood modification began in 1930s. Out of these researches, chemical, biological processes, and/or physical processes have been applied on wooden boards to enhance their dimension stability and counter corrosion. There have been active modification methods, i.e., changing chemical properties of materials, passive modification methods, i.e., not changing chemical properties of materials, and combined modification methods. Through a series of modification techniques of physical and chemical treatment, wood can improve and overcome the defects of fresh wood, such as drying shrinkage, wet expansion, dimensional instability, discoloring, flammability, corrosion, and wear. At the same time, they can give wood some beneficial functions, like, making a low-grade wood high grade, or extending the service life of the wood.

However, the current prevailing wood modification technology is mainly heat treatment technology, which involves putting wooden boards into a large-scale kiln. The heat treatment technology with a kiln has a drawback that it is very hard to distribute the heat evenly, and, thus, the wood board is not evenly heated and the degree of carbonization is not consistent. It is easy to cause local burning, bulging, deformation, cracking, etc. Furthermore, the current heat treatment gradually increases temperature, causing high energy consumption, a long production cycle, and it can also lead to the loss of wood bending strength, probably making the subsequent use of wood not to meet standard requirements.

For all the foregoing shortcomings and needs for wood modification by a heat treatment, an innovative system and method of wood modification heat treatment are desirable.

OBJECT OF THE INVENTION

Accordingly, it is an object of this invention to provide an innovative system and method of wood processing.

It is an object of the invention to provide an innovative system and method of wood modification by heat.

It is another object of the invention to provide an innovative system and method of wood carbonization process and system to overcome the defects of traditional heat-treated wood.

It is another object of the invention to provide an innovative system and method of wood carbonization process and system to overcome the defects of traditional heat-treated wood.

It is another object of the invention to provide an innovative system and method of wood processing where low production costs are achieved for mass production.

SUMMARY OF INVENTION

In one aspect of the invention, a continuous wood modification by heat process is disclosed, that comprises: stacking wooden boards on a trolley at intervals; exerting pressure on the wooden boards; transferring the wooden boards to a heating kiln, pre-heated by microwave and hot air circulation, that has a water vapor flow of 2-5 meter3/hour, a temperature range of 60-100° C., and a humidity range of 50%-100%; transferring the wooden boards to a shallow drying kiln, pre-heated by microwave and hot air circulation, that has a drying temperature of 100-120° C.; transferring the wooden boards to a deep drying kiln, pre-heated by microwave and hot air circulation, that has a drying temperature of 120-120° C., an oxygen content range of 1-10%, and a water vapor flow rate of 1-10 m3/hour; transferring the wooden boards to a carbonization kiln, pre-heated by microwave and hot air circulation, that has a temperature range of 120-180° C., an oxygen content range of 1%-5%; transferring the wooden boards to a slow cooling kiln, that has a temperature range of 120-130° C., and an oxygen content range of 1%-10%; transferring the wooden boards to a fast cooling kiln, that has a temperature range of 90-100° C.; transferring the wooden boards to a rewetting kiln, that has a humidity range of 50%-100%; providing water vapor to the rewetting kiln; while being in the rewetting kiln, and when a temperature range of the wooden boards is 40-60° C., and a moisture content of the wooden boards is 6%-10%, transferring the wooden boards out of the rewetting kiln; wherein each of the heating kiln, the shallow drying kiln, the deep drying kiln, the carbonization kiln, the slow cooling kiln, the fast cooling kiln, and the rewetting kiln comprises a fan, a partition board, a shunt hood, and an exhaust port; wherein the partition board divides an interior of each of the heating kiln, the shallow drying kiln, the deep drying kiln, the carbonization kiln, the slow cooling kiln, the fast cooling kiln, and the rewetting kiln into an upper chamber and a lower chamber; wherein the shunt hood is disposed in the upper chamber; wherein the fan, the shunt hood, and the lower chamber are connected and form a air channel; wherein the lower chamber comprises a shunt plate, disposed along left and right walls of a kiln; wherein the shunting plate comprises a plurality of sieve holes that are disposed gradually dense from top to bottom; wherein one end of the shunt plate is connected with the partition board and the other end is connected with the bottom of a kiln.

In one embodiment, there is an equal gradient temperature rise setting among the heating kiln, the shallow drying kiln, the deep drying kiln, and the carbonization kiln. In one embodiment, there is an equal gradient temperature drop setting among the slow cooling kiln, the fast cooling kiln, and the rewetting kiln. In one embodiment, wherein after the wooden boards being in the heating kiln, the shallow drying kiln, the deep drying kiln, the carbonization kiln, the slow cooling kiln, the fast cooling kiln, and the rewetting kiln more than 0 h and less than 2 h, there is a circulating air in the heating kiln, the shallow drying kiln, the deep drying kiln, the carbonization kiln, the slow cooling kiln, the fast cooling kiln, and the rewetting kiln. In one embodiment, wherein which is characterized in that, in the same process step, the temperature difference among the kilns is less than or equal to 20° C. In one embodiment, wherein the wooden boards are dried to a moisture content of 10%-30% in advance before entering the heating kiln. In one embodiment, wherein a water vapor flow range is 1-10 m3/h in the heating kiln, the shallow drying kiln, the deep drying kiln, and the carbonization kiln. In one embodiment the claim further comprises a plurality of the heating kiln, the shallow drying kiln, the deep drying kiln, the carbonization kiln, the slow cooling kiln, the fast cooling kiln, and the rewetting kiln. In one embodiment, the plurality of kilns are sequentially connected in series. In one embodiment, the process is comprised a trolley. In one embodiment, the claim further comprises a transporting device for driving the trolley. In one embodiment each of the heating kiln, the shallow drying kiln, the deep drying kiln, and the carbonization kiln comprises a microwave source that comprises at least one microwave power supply, one microwave magnetron, and one microwave emitting antenna; wherein the microwave power supply and the microwave magnetron are disposed in a heat-insulated space above the partition board in the upper chamber; wherein the microwave emitting antenna is vertically connected to the insulated space, and extending downward into the lower chamber, and comprises a plurality of microwave emitting holes that face the wooden boards; wherein the microwave emitting holes are staggered vertically. In one embodiment each of the heating kiln, the shallow drying kiln, the deep drying kiln, the carbonization kiln, the slow cooling kiln, the fast cooling kiln, and the rewetting kiln, comprises a steam nozzle connected with a steam source; wherein the steam source is a high power boiler; wherein the steam nozzle is an atomizer. In one embodiment each of the heating kiln, the shallow drying kiln, the deep drying kiln, and the carbonization kiln, comprises a radiator; wherein the radiator is connected with the shunt hood, the fan, and the lower chamber, and a part of an air channel. In one embodiment each of the slow cooling kiln and the fast cooling kiln comprises an air conditioner; wherein the air conditioner is connected with the shunt hood, the fan, and the lower chamber, and a part of an air channel. In one embodiment wherein the pressure is exerted by a tie-down mechanism that comprises a batten bar, a metal chain, a two-way hook spring, and a ratchet component; wherein the tie-down mechanism further comprises spacing strips that are disposed between the wooden boards.

BRIEF DESCRIPTION OF THE DRAWINGS

These and other features and advantages of the invention will not be described with reference to the drawings of certain preferred embodiments, which are intended to illustrate and not to limit the invention, and in which.

DETAILED DESCRIPTION OF THE INVENTION

Some embodiments are described in detail with reference to the related drawings. Additional embodiments, features, and/or advantages will become apparent from the ensuing description or may be learned by practicing the invention. The following description is not to be taken in a limiting sense, but is made merely for the purpose of describing the general principles of the invention. The steps described herein for performing methods form one embodiment of the invention, and, unless otherwise indicated, not all of the steps must necessarily be performed to practice the invention, nor must the steps necessarily be performed in the order listed. It should be noted that references to "an" or "one" or "some" embodiment(s) in this disclosure are not necessarily to the same embodiment, and such references mean at least one.

The present invention has been conceived with the aim of addressing one or more problems of current wood modification methods. More specifically, the present invention is directed to a method and system for a wood modification process by heat.

Figure 1:
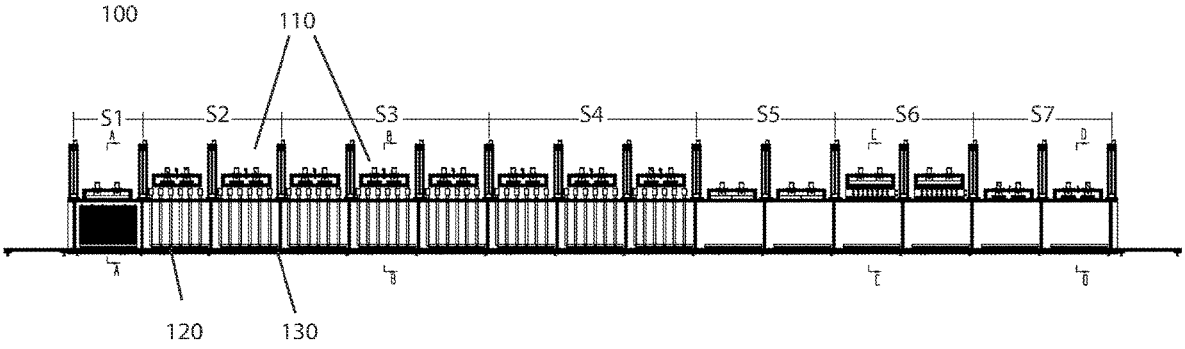
FIG. 1 illustrates an embodiment of the current invention for a continuous wood carbonization process.

FIG. 1 illustrates an embodiment 100 of the current invention's continuous process of wood modification by heat. The embodiment comprises a plurality of kilns 110, a trolley 120, and a transportation device 130 at the bottom of the kilns for moving the trolley. A plurality of said kilns 110 are sequentially connected in series along the forward direction of the trolley 120. Each kiln comprises two doors disposed at the ends thereof. The plurality of kilns comprises a preheating kiln S1, a heating kiln S2, a drying kiln S3, a carbonization kiln S4, a slow cooling kiln S5, a fast cooling kiln S6, and a rewetting kiln Step 7:

The wooden boards are stacked on the trolley at intervals, and a pressure is exerted from the top to keep the stress of boards balanced and even, and the following treatment steps are successively followed:

Step 1, hereinafter, "S1", is a preheating process that causes the trolley carrying the wooden boards to enter a preheating kiln that maintains a preheating temperature of about 30-50° C.;

Step 2, hereinafter, "S2", is a heating up process that causes the trolley of S1 to enter a heating kiln that maintains a water vapor flow of about 2-5 cubic meters/hour, and a temperature of about 60-100° C., and a humidity range of about 50%-100%;

Step 3, hereinafter, "S3", is a drying process that comprises two sub-steps. The first sub-step is to cause the trolley of S2 to enter a shallow drying kiln that maintains a temperature of about 100-120° C. The second sub-step is to cause the trolley of the first sub-step to enter a deep drying kiln that maintains a temperature of 120-120° C., and an oxygen content of a range of 1-10%, and a water vapor flow rate of about 1-10 cubic meters/hour. Both heat sources of these two sub-steps are microwave heat and hot air circulation;

Step 4, hereinafter, "S4", is a carbonization process that causes the trolley of S3 to enter a carbonization kiln that maintains a temperature of about 120-180° C., and oxygen content range is 1%-5%. This kiln's heat source is also microwave and hot air circulation;

Step 5, hereinafter, "S5", is a slow cooling process that causes the trolley of S4 to enter a slow cooling kiln that maintains a temperature of 120-130° C., and an oxygen content range of 1%-10%;

Step 6, hereinafter, "S6", is a fast cooling process that causes the trolley of S5 to enter a fast cooling kiln that maintains a temperature of 90-100° C.;

Step 7, hereinafter, "S7", is a rewetting process that causes the trolley of S6 to enter a rewetting kiln that maintains humidity range of 50%-100%. When the wooden boards on the trolley cool down to 40-60° C., and the moisture content is 6%-10%, the trolley is pushed out of the kiln;

Each process step includes multiple kilns. In steps S2-S4, there is an even gradient temperature increase setting among kilns, and in steps S5-S7, there is an even gradient temperature decrease setting among kilns. When the process time of each kiln is more than 0 and less than 2 h, there is circulating air in the kiln.

In one preferred embodiment, in the same process step, the temperature difference among the kilns is less than or equal to 20° C.; and the wooden boards are dried to the moisture content of 10%-30% in advance before entering the kiln; the water vapor flow during the processes of S2-S4 is 1-10 m3/h.

After the boards leave the kilns and the kilns are empty, the S2's to S4's flow of water vapor is 0-2 m3/h, and, gradually, the kilns' water vapors stop.

Figure 2:
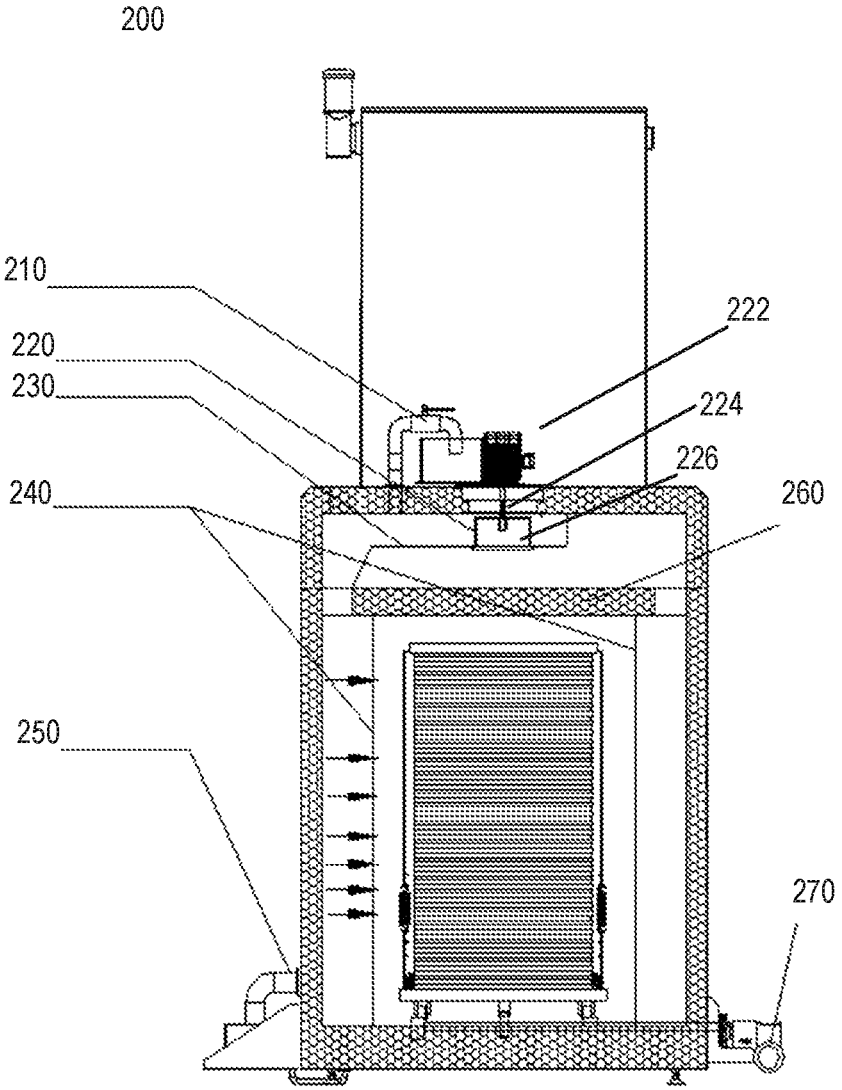
FIG. 2 illustrates a cross section of an embodiment of the current invention's preheating kiln.

FIG. 2 illustrates a cross section of an exemplary kiln 200 of the current invention. This embodiment of kiln 200 comprises an exhaustion port 210 to let any vapor excess escape, a partition board 260 that partitions the kiln's interior into the upper and lower chambers. This embodiment further comprises a fan 220 with a motor 222 being attached to the top of this kiln on the outside, and its shaft 224 extending downward through the top of the kiln to reach the upper chamber of the kiln, the lower part 226 of the fan 220 is attached to a shunt hood 230 that is also attached to the partition board 260. It is appreciated that the fan 220 can be a circulating fan, or a device that moves air. It is also appreciated that the area of the partition board 260 is larger than the area of the wooden boards on the trolley. kiln further comprises shunt plates 240 that are disposed parallel to the kiln's side walls inside the lower chamber of the kiln. The shunt plates 240 further comprises multiple sieve holes that, at the air inlet side, are distributed from top to bottom and gradually dense. One end of the shunting plate 4 is connected with the partition board 6 and the other end is connected with the bottom of the kiln. This kiln comprises an additional exhaustion port 250 that is connected to the kiln's side wall on the outside. This kiln further comprises a transportation component 270 that causes the trolley carrying the treated wooden boards to move through the kiln. In one embodiment, the kiln further comprises a thermometer that can be a dry and wet bulb thermometer, and disposed on the top wall of the kiln and on the air inlet side.

Figure 3:
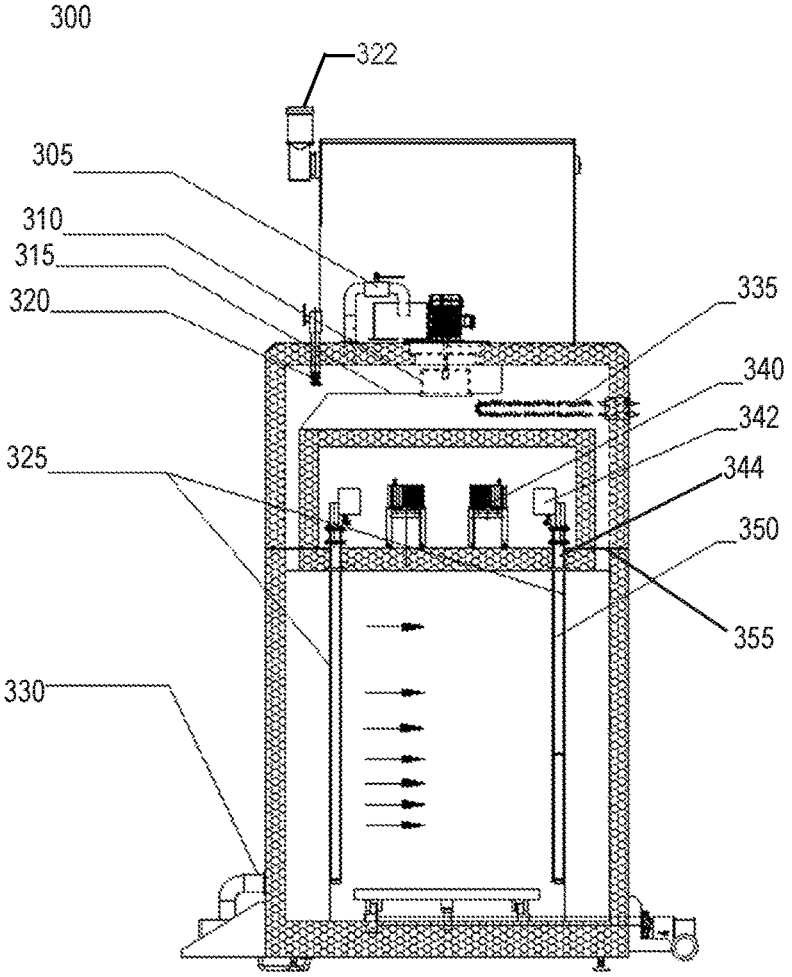
FIG. 3 illustrates a cross section of an embodiment of the current invention's heat kiln, drying kiln and carbonization kiln.

FIG. 3 illustrates a cross section of another exemplary kiln 300 of the current invention. Similar to FIG. 2 embodiment, this embodiment of kiln 300 comprises an exhaustion port 305 at the top and exhaustion port 330 near the bottom of the kiln to let any vapor excess escape; a partition board 355 that partitions the kiln's interior into the upper and lower chambers; a fan 310 at the top of the kiln on the outside that is connected and attached to a shunt hood 315 that is disposed inside the kiln in the upper chamber, and connected and attached to the partition board 355; shunt plates 325 that are disposed inside parallel to the kiln's side walls. This kiln further comprises a steam nozzle 320 that provides necessary water vapor to rewet the treated wooden boards. The steam nozzle is attached to the top of the kiln and connected to a high-pressure steam boiler 322. In one embodiment, the steam nozzle is an atomizer that can spray fine mist. In one embodiment, the kiln further comprises a radiator tube 335 that in conjunction with the fan 310, shunt hood 315, partition board 355, and kiln wall, provides a heating source to maintain the temperature in the kiln. This kiln further comprises at least one microwave magnetron 340, and at least one microwave power supply 342, that are disposed within a heat-insulated space above the partition board 355 in the upper chamber of the kiln, and a microwave conducting pipe 344 that is receiving the microwaves of the microwave magnetron 340, and directing them to a connected microwave emitting antenna 350 that, in turn, directs microwaves to the wooden boards on the trolley. It is appreciated that at least one microwave emitting antenna 350 is disposed along the shunt plates 325 to provide enough power to achieve a desired heat in a desired time period. The microwave emitting antenna 350 comprises holes facing the treated wooden boards on the trolley. The holes are staggered in the vertical direction. In one embodiment, the rated frequency of the microwave magnetron 340 is 915 MHZ or 2,450 HZ.

Figure 4:
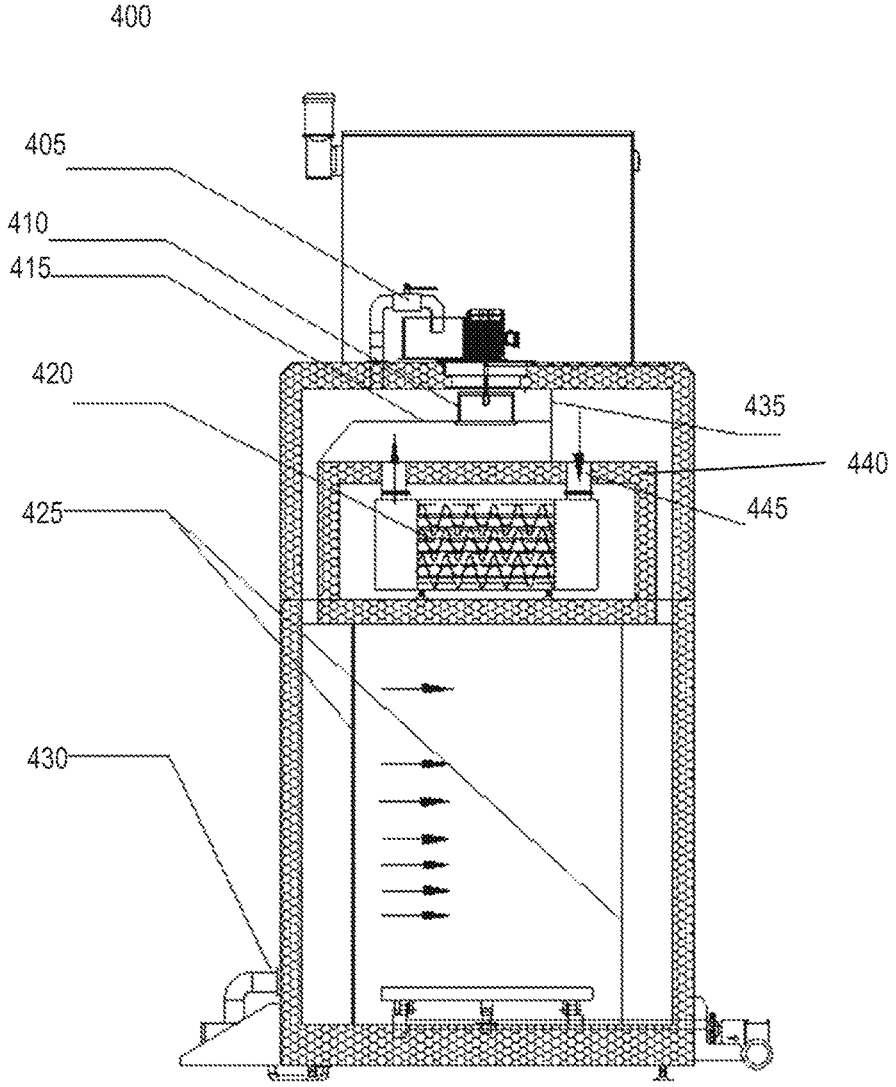
FIG. 4 illustrates a cross section of an embodiment of the current invention's slow cooling kiln.

FIG. 4 illustrates a cross section of another exemplary kiln 400 of the current invention. Similar to FIGS. 2 and 3 embodiments, this embodiment 400 comprises an exhaustion port 405 at the top and exhaustion port 430 near the bottom of the kiln to let any vapor excess escape; a partition board 440 that partitions the kiln's interior into the upper and lower chambers; a fan 410 at the top of the kiln on the outside that is connected and attached to a shunt hood 415 that is disposed inside the kiln in the upper chamber, and connected and attached to the partition board 440; shunt plates 425 that are disposed inside parallel to the kiln's side walls. In this kiln, the partition board 440 further comprises two openings 445 on the opposite sides of the partition board. This kiln further comprises a radiator 420 that is disposed in the upper chamber and provides heat for the lower chamber; a second partition board 435 that upper chamber into left and right chambers. The right chambers and the right opening 445 of the partition board 440 form a channel to let incoming air flowing in the radiator 420. The left chambers and the left opening 445 of the partition board 440 form a channel to let hot air flowing away from the radiator 420. The hot air is further dispersed by the fan 410, and directed by the shunt hood 415 to lower chamber of the kiln 400. It is appreciated that in another embodiment the radiator 420 can be replaced with an air conditioner to provide fast cooling of the wooden boards.

Figure 5:
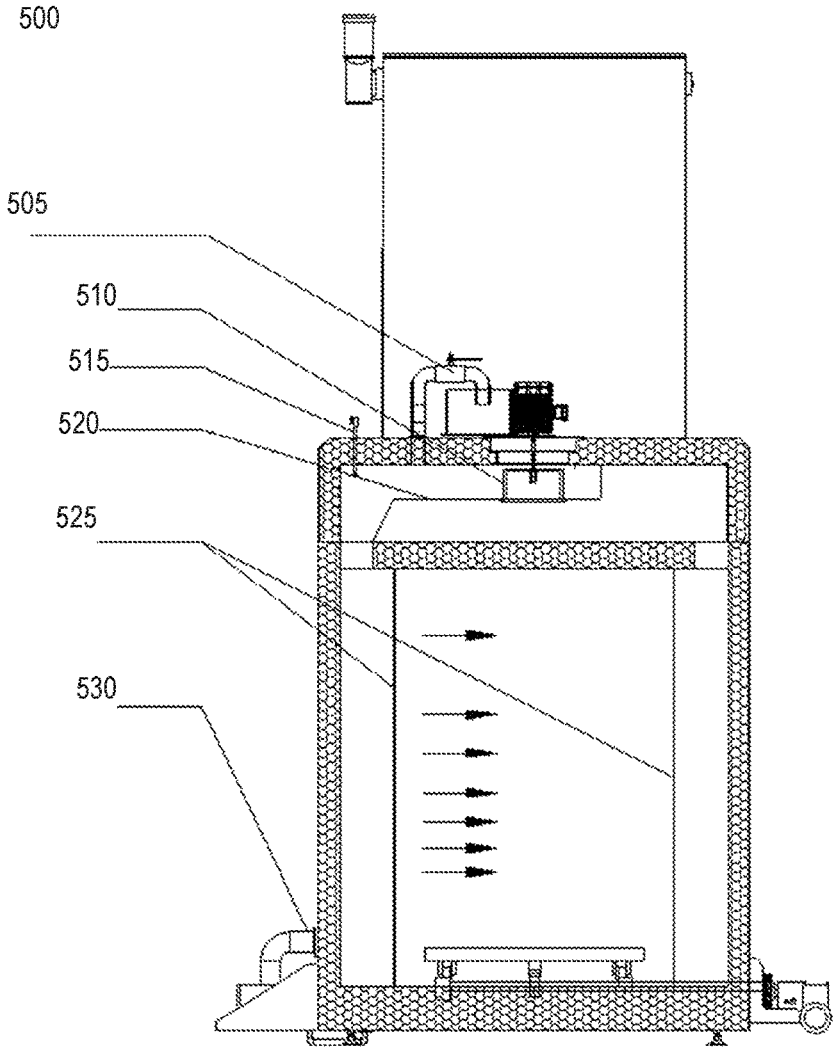
FIG. 5 illustrates a cross section of an embodiment of the current invention's rewetting kiln.

FIG. 5 illustrates a cross section of another exemplary kiln 500 of the current invention. Similar to FIGS. 2 and 3 embodiments, this embodiment 500 comprises an exhaustion port 505 at the top and exhaustion port 530 near the bottom of the kiln to let any vapor excess escape; a partition board 540 that partitions the kiln's interior into the upper and lower chambers; a fan 510 at the top of the kiln on the outside that is connected and attached to a shunt hood 520 that is disposed inside the kiln in the upper chamber, and connected and attached to the partition board 540; shunt plates 525 that are disposed inside parallel to the kiln's side walls. This kiln further comprises a spray pipe 515.

Figure 6:
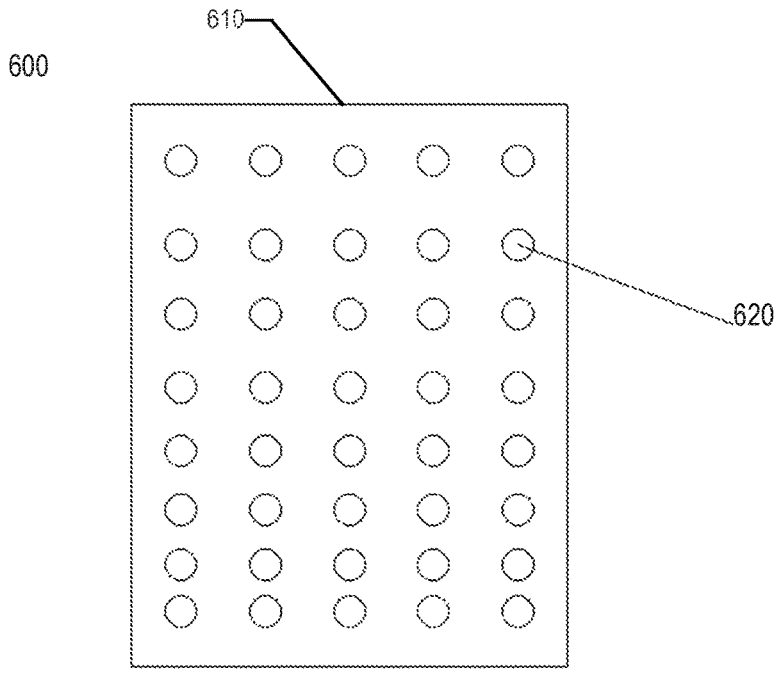
FIG. 6 illustrates a front of an embodiment of the current invention's air inlet side shunt plate.

FIG. 6 illustrates the front view of an exemplary microwave emitting antenna 610 of an embodiment 600 of the current invention. This embodiment of emitting antenna 610 comprises multiple rows and columns of emitting holes 620. It is appreciated that the emitting holes 620 can be staggered in a variety of patterns to achieve the heat and effect for different wooden boards and/or load.

Figure 7:
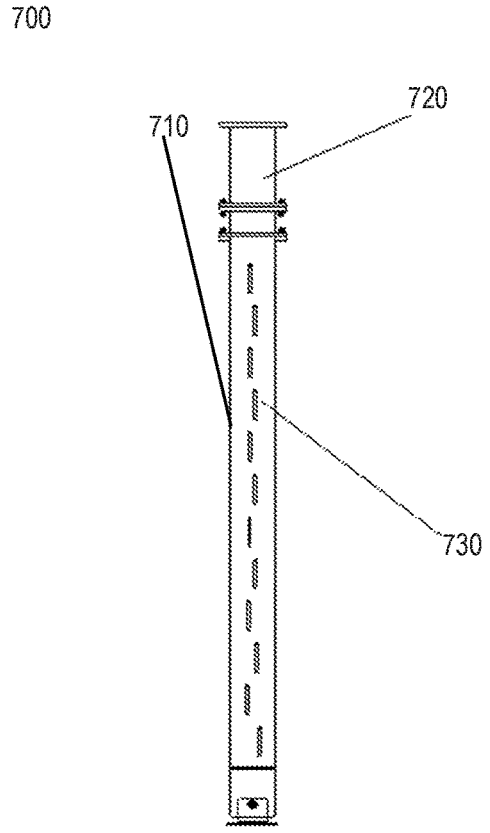
FIG. 7 illustrates a front of an embodiment of the current invention's microwave emitting antenna.

FIG. 7 illustrates the front view of an exemplary microwave emitting antenna 710 of an embodiment 700 of the current invention. This embodiment of the emitting antenna 710 comprises a microwave conducting pipe 720 that directs microwaves toward multiple staggered emitting holes 730. It is appreciated that the emitting holes 720 can be different sizes and shapes to achieve the heat and effect for different wooden boards and/or load.

Figure 8:
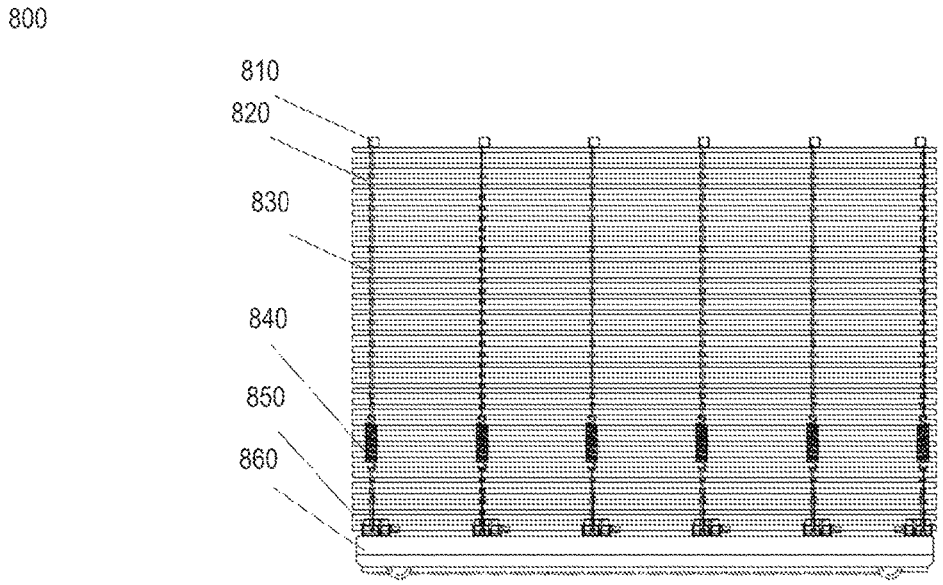
FIG. 8 illustrates a side of an embodiment of the current invention's trolley.

FIG. 8 illustrates the side view of an exemplary trolley 800 of the current invention. This embodiment comprises a batten bar 810 that lies across the treated wooden boards and presses the boards down evenly across the boards' width. The embodiment further comprises a metal chain 820 that is attached to the batten bar 810 and pulls and holds the bar down against the top of the wooden boards. It is appreciated that chain 820 can be made of other materials as long as it can still perform its functions in a high temperature kiln. In one embodiment, the chain 820 can be a steel wire rope. The embodiment further comprises spaces 830 placed between the wooden boards to allow an air gap in between that in turn allows hot air or water vapor contacts both surfaces of a wooden board. The embodiment further comprises an elastic element 840 to give the tie-down mechanism some yield. In one embodiment, the elastic element 840 is a two-way hook spring. The embodiment further comprises a ratchet 850 that allows pulling of chain 820 to tie down the wooden boards to the trolley 800. The embodiment further comprises a bottom frame 860 of the trolley 800 that in turn comprises a metal wire bottom bed (not shown) to allow hot dry air and vapor contacting the bottom wooden board.

Figure 9:
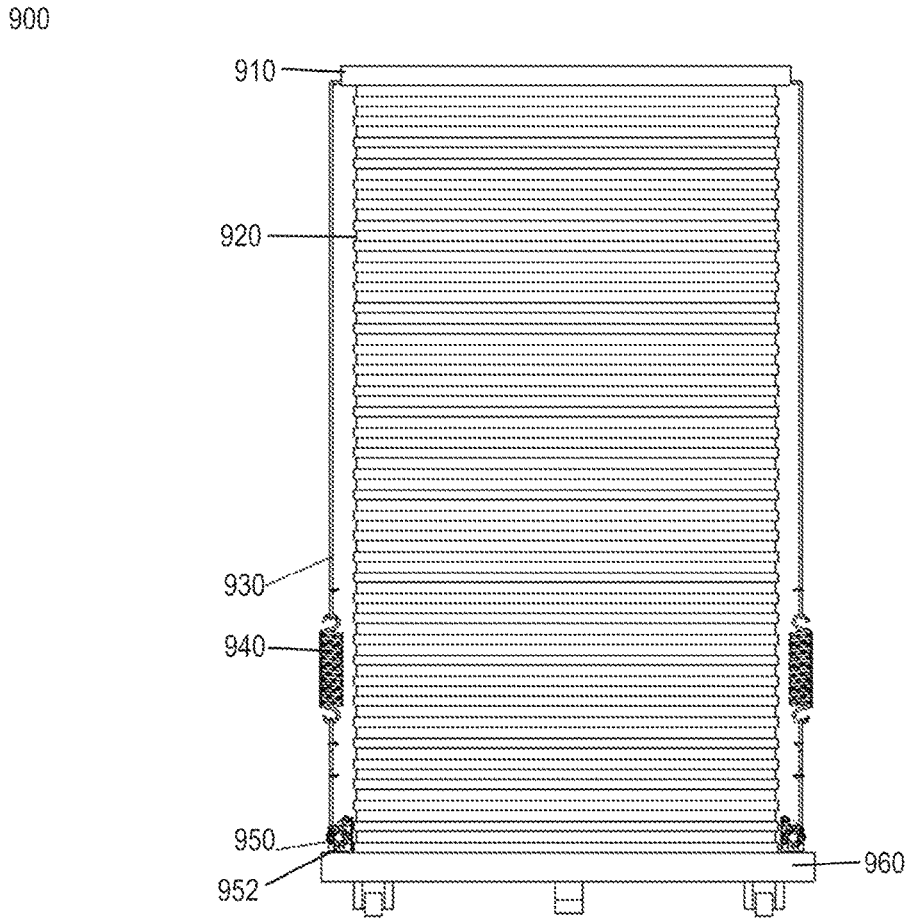
FIG. 9 illustrates a front of an embodiment of the current invention's trolley.

FIG. 9 illustrates the front view of an exemplary trolley 900 of the current invention. Similar to the embodiment 800, this embodiment comprises a batten bar 910 that lies across the treated wooden boards and presses the boards down evenly across the boards' width. This embodiment further comprises spaces 920 placed between the wooden boards to allow an air gap in between that in turn allows hot air or water vapor contacts both surfaces of a wooden board. This embodiment further comprises a metal chain 930 that is attached to the batten bar 910 and pulls and holds the bar down against the top of the wooden boards. This embodiment further comprises an elastic element 940 to give the tie-down mechanism some yield. This embodiment further comprises a set of ratchet gears 950 that when individual gear 952 is turned the tie-down mechanism pulls the metal chain 930 and, indirectly, the batten bar 910 down, toward the bottom of the trolley 900, and, thus, presses and holds down the wooden boards on the trolley. The embodiment further comprises a bottom frame 960 of the trolley 900.

Figure 10:
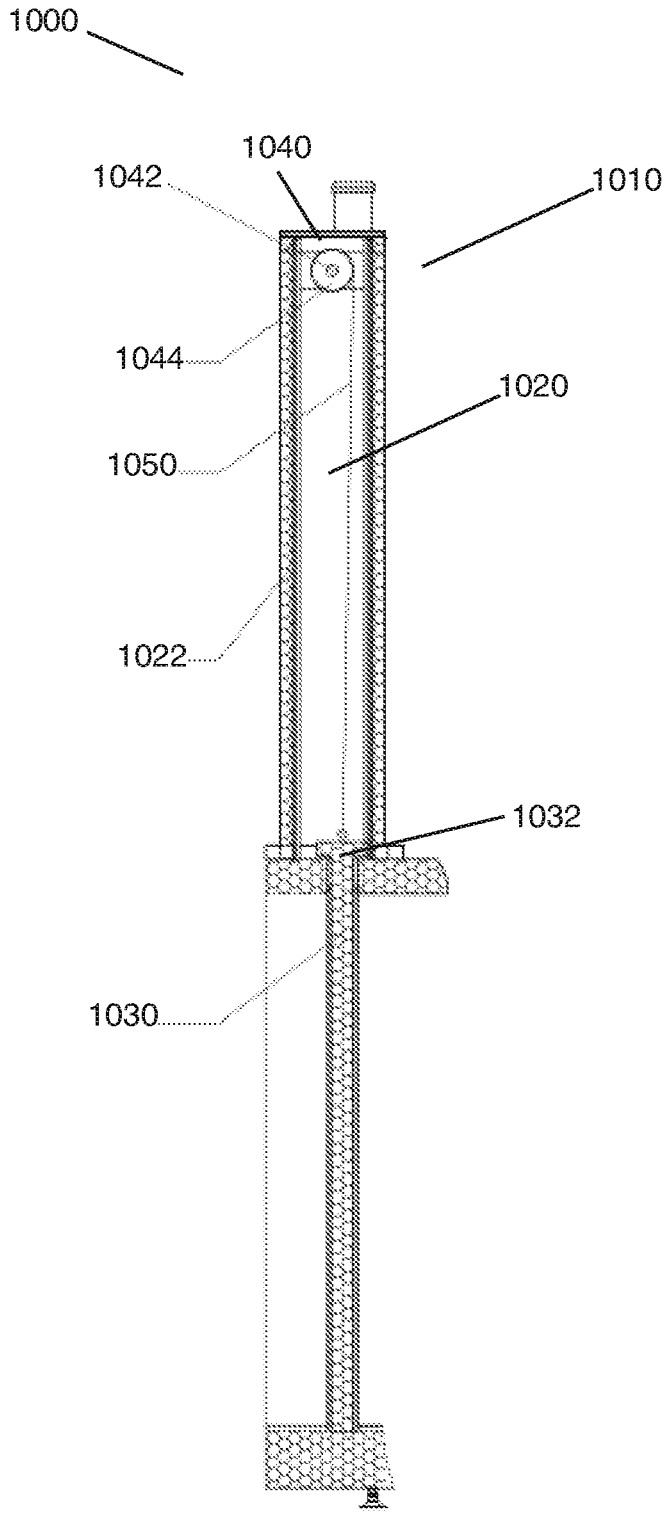
FIG. 10 illustrates an embodiment of the current invention's kilt door assembly.

FIG. 10 illustrates an embodiment 1000 of the current invention that comprises a kiln door assembly 1010 that, in turn, comprises a cavity 1020. Disposed inside the cavity 1020 is a door frame to receive a kiln door 1030 as the kiln is opened. Also, within the cavity 1020, a pulley 1040 is disposed. The pulley 1040 comprises an axle 1042 and wheels 1044, among other fastening components. The axle 1042 extends through the center of and beyond the wheel 1044, and is connected with a motor (not shown). The door assembly 1010 further comprises a pull rope 1040 that wraps around the wheel 144, and its other end is connected to the top of the kiln door 1030. When closed, the kiln door 1030 is the kiln wall along the direction of trolley carrying wooden boards for processing. The kiln door 1030 further comprises a T-shape top edge 1032 that is covered with at least one silicon rubber seal strip. Thus, when the door is closed down, the silicon rubber seal strip will plug any gap/hole along the opening at the bottom of the cavity 1020. The walls of the cavity 1020 are insulated with thermal insulation plates 1022. The kiln door is also insulated with at least one layer of thermal insulation layer that comprises insulating asbestos sandwiched between a thermal insulation plate and a graphite microwave isolation plate.

The exemplary processes of the current invention are disclosed below. The wooden boards are made of oak.

Case 1:

The wooden boards are stacked on the trolley at intervals, and the pressure is exerted on the top to keep the stress of boards balanced and even.

Step 1: transferring the trolley carrying the wooden boards to a preheating kiln, and the preheating process temperature is 30° C.;

Step 2: transferring the wooden boards of Step 1 to a heating kiln, which includes 2 heating kilns with the temperature of 80° C. and 100° C. In this step, the microwave power accounts for 30% of the total heating power, the water vapor flow is 2 $m^3$/h, and the humidity is 50%.

Step 3: first, transferring the treated wooden boards of Step 2 to a first drying kiln, with the drying process temperature of 120° C. Second, transferring the treated wooden boards to a second drying kiln, with the drying process temperature of 120° C. The oxygen content of the drying process is 1%, which is heated by microwave and hot air circulation. In this step, the microwave power accounts for 40% of the total heating power, and the water vapor flow is 5 $m^3$/h.

Step 4: transferring the treated wooden boards of Step 3 to a carbonization kiln, and this step includes 3 carbonization kilns, having 140° C., 160° C. and 180° C. respectively; the oxygen content is 1%, and it is heated by microwave and hot air circulation; the proportion of microwave power is 20%, and the water vapor flow is 4 $m^3$/h.

Step 5: transferring the treated wooden boards of Step 4 to a slow cooling kiln that has a temperature of slow cooling process is 125° C., and the oxygen content is 1%.

Step 6: transferring the treated wooden boards of Step 5 to a fast cooling kiln, and the temperature of fast cooling process is 90° C.

Step 7: transferring the treated wooden boards of Step 6 to a rewetting kiln that has a humidity of 50%. When the temperature of the wooden boards is 40° C., and the moisture content is 6%-8%, transferring the treated wooden boards out of the kiln.

Furthermore, steps 2-4 have an equal gradient temperature rise setting among kilns, and Steps 5-7 have an equal gradient temperature dropping setting among kilns. When the wooden boards process time of each kiln is 1 h, there is circulating air in the kiln.

Before this modification process, the wood boards are dried in advance until the moisture content is 10%-12%, and the temperature of each kiln is set at a preset temperature.

This particular exemplary process yields oak boards having moisture content of 6%-8%; shrinkage rate of heat-resistant dimension of ≤0.04%, longitudinally, and ≤1.2%, latitudinally; moisture resistant dimensional expansion rate of ≤0.2%, longitudinally, and ≤0.7%, latitudinally. There was no crack or bubble on the surface.

The production cycle was 5 days, the total process was 30 hours, the strength was uniform, the bending strength was 115.8 MPa, and the modulus of elasticity was 7.5 GPa.

Case 2:

The wooden boards are stacked on the trolley at intervals, and the pressure is exerted on the top to keep the stress of boards balanced and even.

Step 1: transferring the trolley carrying the wooden boards to a preheating kiln, and the preheating process temperature is 50° C.;

Step 2: transferring the wooden boards of Step 1 to a heating kiln, which includes 2 heating kilns with the temperature of 60° C. and 80° C. In this step, the microwave power accounts for 33% of the total heating power, the water vapor flow is 5 $m^3$/h, and the humidity is 100%.

Step 3: first, transferring the treated wooden boards of Step 2 to a first drying kiln, with the drying process temperature of 100° C. Second, transferring the treated wooden boards to a second drying kiln, with the drying process temperature of 120° C. The oxygen content of the drying process is 5%, which is heated by microwave and hot air circulation. In this step, the microwave power accounts for 40% of the total heating power, and the water vapor flow is 8 $m^3$/h.

Step 4: transferring the treated wooden boards of Step 3 to a carbonization kiln, and this step includes 3 carbonization kilns, having 120° C., 135° C. and 150° C. respectively; the oxygen content is 3%, and it is heated by microwave and hot air circulation; the proportion of microwave power is 20%, and the water vapor flow is 3 $m^3$/h.

Step 5: transferring the treated wooden boards of Step 4 to a slow cooling kiln that has a temperature of slow cooling process is 130° C., and the oxygen content is 5%.

Step 6: transferring the treated wooden boards of Step 5 to a fast cooling kiln, and the temperature of fast cooling process is 100° C.

Step 7: transferring the treated wooden boards of Step 6 to a rewetting kiln that has a humidity of 80%. When the temperature of the wooden boards is 60° C., and the moisture content is 8%-10%, transferring the treated wooden boards out of the kiln.

Furthermore, Steps 2-4 have an equal gradient temperature rise setting among kilns, and Steps 5-7 have an equal gradient temperature dropping setting among kilns. When the wooden boards process time of each kiln is 0.5 h, there is circulating air in the kiln.

Before this modification process, the wood boards are dried in advance until the moisture content is 18%-20%, and the temperature of each kiln is set at a preset temperature.

The dwell time of each kiln is 0.5 h.

This particular exemplary process yields oak boards having moisture content of 8%-10%; shrinkage rate of heat-resistant dimension of ≤0.08%, longitudinally, and ≤1.15%, latitudinally; moisture resistant dimensional expansion rate of ≤0.19%, longitudinally, and ≤0.65%, latitudinally. There was no crack or bubble on the surface.

The production cycle was 5 days, the total process was 32 hours, the strength was uniform, the bending strength was 118.6 MPa, and the modulus of elasticity was 7.8 GPa.

Case 3:

The wooden boards are stacked on the trolley at intervals, and the pressure is exerted on the top to keep the stress of boards balanced and even.

Step 1: transferring the trolley carrying the wooden boards to a preheating kiln, and the preheating process temperature is 40° C.;

Step 2: transferring the wooden boards of Step 1 to a heating kiln, which includes 2 heating kilns with the temperature of 70° C. and 90° C. In this step, the microwave power accounts for 38% of the total heating power, the water vapor flow is 4 $m^3$/h, and the humidity is 100%.

Step 3: first, transferring the treated wooden boards of Step 2 to a first drying kiln, with the drying process temperature of 110° C. Second, transferring the treated wooden boards to a second drying kiln, with the drying process temperature of 120° C. The oxygen content of the drying process is 10%, which is heated by microwave and hot air circulation. In this step, the microwave power accounts for 45% of the total heating power, and the water vapor flow is 9 $m^3$/h.

Step 4: transferring the treated wooden boards of Step 3 to a carbonization kiln, and this step includes 3 carbonization kilns, having 135° C., 150° C. and 175° C. respectively; the oxygen content is 5%, and it is heated by microwave and hot air circulation; the proportion of microwave power is 26%, and the water vapor flow is 5 $m^3$/h.

Step 5: transferring the treated wooden boards of Step 4 to a slow cooling kiln that has a temperature of slow cooling process is 120° C., and the oxygen content is 10%.

Step 6: transferring the treated wooden boards of Step 5 to a fast cooling kiln, and the temperature of fast cooling process is 95° C.

Step 7: transferring the treated wooden boards of Step 6 to a rewetting kiln that has a humidity of 100%. When the temperature of the wooden boards is 42° C., and the moisture content is 8%-9%, transferring the treated wooden boards out of the kiln.

Furthermore, Steps 2-4 have an equal gradient temperature rise setting among kilns, and Steps 5-7 have an equal gradient temperature dropping setting among kilns. When the wooden boards process time of each kiln is 1 h, there is circulating air in the kiln.

Before this modification process, the wood boards are dried in advance until the moisture content is 14%-16%, and the temperature of each kiln is set at a preset temperature.

This particular exemplary process yields oak boards having moisture content of 8%-9%; shrinkage rate of heat-resistant dimension of ≤0.06%, longitudinally, and ≤1.1%, latitudinally; moisture resistant dimensional expansion rate of ≤0.18%, longitudinally, and ≤0.65%, latitudinally. There was no crack or bubble on the surface.

The production cycle was 5 days, the total process was 28 hours, the strength was uniform, the bending strength was 116 MPa, and the modulus of elasticity was 7.6 GPa.

TABLE 1

Oak inspection parameters in the case.

| | Moisture content | Heat resistant shrinkage | | Moisture resistance expansion rate | | Static bending strength | Modulus of elasticity |
|---|---|---|---|---|---|---|---|
| | | Length | Width | Length | Width | MPA | GPA |
| Case 1 | 6%-8% | ≤0.04% | ≤1.2% | ≤0.2% | ≤0.7% | 115.8 | 7.5 |
| Case 2 | 8%-10% | ≤0.08% | ≤1.15% | ≤0.19% | ≤0.65% | 118.6 | 7.8 |
| Case 3 | 8%-9% | ≤0.06% | ≤1.1% | ≤0.18% | ≤0.65% | 116 | 7.6 |

The modified heat treatment process of the invention takes oak wood as the processing object, after treatment, the moisture content of carbonized wood is 5%-10%; the heat-resistant shrinkage rate of wood is: length direction ≤0.2%, width direction ≤1.5%; moisture resistance expansion rate: length direction ≤0.2%, width direction ≤0.8%; the surface is free of cracks and blisters; the total process is 30 hours, with uniform strength. The vertical grain direction of the static bending strength is ≥50 MPa, the transverse grain direction of the static bending strength is ≥45 MPa, the vertical grain direction of the modulus of elasticity is ≥5,000 MPa, and the transverse grain direction of the modulus of elasticity is ≥4,000 MPa. Also the time measured static bending strength is greater than 100 MPa, and the modulus of elasticity is greater than 7,000 MPa.

It should be noted that in this paper, the term "including" or any other variation thereof is intended to cover non-exclusive inclusion, so that a process, method, article or device including a series of elements includes not only those elements, but also other elements not explicitly listed, or also includes inherent elements for such process, method, article or device.

In this paper, specific examples are applied to explain the principle and implementation mode of the invention. The above examples are only used to help understand the method and core idea of the invention. The above is only the preferred embodiment of the invention. It should be pointed out that due to the limitation of literal expression, there are infinite concrete structures objectively. For ordinary technicians in the technical field, without departing from the principles of the invention, they can also make some improvements, embellishments or changes, or combine the above technical features in an appropriate way; any modification, change or combination, or direct application of the concept and technical scheme of the invention to other occasions without improvement, shall be deemed as the protection scope of the invention.

The invention claimed is:

1. A continuous wood modification by heat process, that comprises:

a. stacking wooden boards on a trolley at intervals;

b. exerting pressure on said wooden boards;

c. transferring said wooden boards to a heating kiln, pre-heated by microwave and hot air circulation, that has a water vapor flow of 2-5 meter3/hour, a temperature range of 60-100 C, and a humidity range of 50%-100%;

d. transferring said wooden boards to a shallow drying kiln, pre-heated by microwave and hot air circulation, that has a drying temperature of 100-120° C.;

e. transferring said wooden boards to a deep drying kiln, pre-heated by microwave and hot air circulation, that has a drying temperature of 120-120 C, an oxygen content range of 1-10%, and a water vapor flow rate of 1-10 m3/hour;

f. transferring said wooden boards to a carbonization kiln, pre-heated by microwave and hot air circulation, that has a temperature range of 120-180 C, an oxygen content range of 1%-5%;

g. transferring said wooden boards to a slow cooling kiln, that has a temperature range of 120-130 C, and an oxygen content range of 1%-10%;

h. transferring said wooden boards to a fast cooling kiln, that has a temperature range of 90-100° C.;

i. transferring said wooden boards to a rewetting kiln, that has a humidity range of 50%-100%;

j. providing water vapor to said rewetting kiln;

k. while being in said rewetting kiln, and when a temperature range of said wooden boards is 40-60° C., and a moisture content of said wooden boards is 6%-10%, transferring l. said wooden boards out of said rewetting kiln;

m. wherein each of said heating kiln, said shallow drying kiln, said deep drying kiln, said carbonization kiln, said slow cooling kiln, said fast cooling kiln, and said rewetting kiln comprises a fan, a partition board, a shunt hood, and an exhaust port;

n. wherein said partition board divides an interior of each of said heating kiln, said shallow drying kiln, said deep drying kiln, said carbonization kiln, said slow cooling kiln, said fast cooling kiln, and said rewetting kiln into an upper chamber and a lower chamber;

o. wherein said shunt hood is disposed in said upper chamber;

p. wherein said fan, said shunt hood, and said lower chamber are connected and form an air channel;

q. wherein said lower chamber comprises a shunt plate, disposed along left and right walls of a kiln;

r. wherein said shunting plate comprises a plurality of sieve holes that are disposed gradually dense from top to bottom;

wherein one end of said shunt plate is connected with said partition board and the other end of said shunt plate is connected with a bottom of a kiln.

2. The process of claim 1, wherein there is an equal gradient temperature rise setting among said heating kiln, said shallow drying kiln, said deep drying kiln, and said carbonization kiln.

3. The process of claim 1, wherein there is an equal gradient temperature drop setting among said slow cooling kiln, said fast cooling kiln, and said rewetting kiln.

4. The process of claim 1, wherein after said wooden boards being in said heating kiln, said shallow drying kiln, said deep drying kiln, said carbonization kiln, said slow cooling kiln, said fast cooling kiln, and said rewetting kiln more than Oh and less than 2 h, there is a circulating air in said heating kiln, said shallow drying kiln, said deep drying kiln, said carbonization kiln, said slow cooling kiln, said fast cooling kiln, and said rewetting kiln.

5. The process of claim 1, wherein which is characterized in that, in the same process step, the temperature difference among the kilns is less than or equal to 20° C.

6. The process of claim 1, wherein said wooden boards are dried to a moisture content of 10%-30% in advance before entering said heating kiln.

7. The process of claim 1, wherein a water vapor flow range is 1-10 m3/h in said heating kiln, said shallow drying kiln, said deep drying kiln, and said carbonization kiln.

8. The process of claim 1 comprises a plurality of said heating kiln, said shallow drying kiln, said deep drying kiln, said carbonization kiln, said slow cooling kiln, said fast cooling kiln, and said rewetting kiln.

9. The process of claim 8, wherein said plurality of kilns are sequentially connected in series.

10. The process of claim 1 comprises a trolley.

11. The process of claim 10 further comprises a transporting device for driving said trolley.

12. The process of claim 1, wherein each of said heating kiln, said shallow drying kiln, said deep drying kiln, and said carbonization kiln comprises a microwave source that comprises at least one microwave power supply, one microwave magnetron, and one microwave emitting antenna; wherein said microwave power supply and said microwave magnetron are disposed in a heat-insulated space above said partition board in said upper chamber; wherein said microwave emitting antenna is vertically connected to said insulated space, and extending downward into said lower chamber, and comprises a plurality of microwave emitting holes that face said wooden boards; wherein said microwave emitting holes are staggered vertically.

13. The process of claim 1, wherein each of said heating kiln, said shallow drying kiln, said deep drying kiln, said carbonization kiln, said slow cooling kiln, said fast cooling kiln, and said rewetting kiln, comprises a steam nozzle connected with a steam source; wherein said steam source is a high power boiler; wherein said steam nozzle is an atomizer.

14. The process of claim 1, wherein each of said heating kiln, said shallow drying kiln, said deep drying kiln, and said carbonization kiln, comprises a radiator; wherein said radiator is connected with said shunt hood, said fan, and said lower chamber, and a part of an air channel.

15. The process of claim 1, wherein each of said slow cooling kiln and said fast cooling kiln comprises an air conditioner; wherein said air conditioner is connected with said shunt hood, said fan, and said lower chamber, and a part of an air channel.

16. The process of claim 1, wherein said pressure is exerted by a tie-down mechanism that comprises a batten bar, a metal chain, a two-way hook spring, and a ratchet component; wherein said tie-down mechanism further comprises spacing strips that are disposed between said wooden boards.

* * * * *